US005501255A

United States Patent [19]

Tortu et al.

[11] Patent Number: 5,501,255

[45] Date of Patent: Mar. 26, 1996

[54] FUEL RECOVERY SYSTEM

[75] Inventors: Matthew P. Tortu, P.O. Box 1008, Delran, N.J. 08075; Jay Ross, Pennington, N.J.

[73] Assignee: Matthew P. Tortu, Deerfield Beach, Fla.

[21] Appl. No.: 330,985

[22] Filed: Oct. 28, 1994

[51] Int. Cl.[6] ..... B65B 1/30; B65B 31/00; B67C 3/02

[52] U.S. Cl. ..... 141/95; 141/44; 141/86; 141/98; 137/202; 137/558; 340/616; 340/619; 73/307; 73/308; 73/314; 116/228

[58] Field of Search ..... 141/83, 86, 95, 141/198, 307, 98, 115, 120, 44, 45; 137/202, 558, 554, 587; 340/616, 618, 619, 623; 73/307, 308, 314, 291; 116/227, 228

[56] References Cited

U.S. PATENT DOCUMENTS

| | | | |
|---|---|---|---|
| 3,096,748 | 11/1961 | Harry | 123/41.15 |
| 3,994,175 | 11/1976 | Yamaguchi et al. | 340/623 |
| 4,014,010 | 3/1977 | Jinotti | 340/619 |
| 4,082,125 | 4/1978 | Wilson et al. | 141/86 |
| 4,133,287 | 1/1979 | Downs | 116/227 |
| 4,361,835 | 11/1982 | Nagy | 340/624 |
| 4,447,743 | 5/1984 | Bean et al. | 307/118 |
| 4,557,216 | 12/1985 | Demyon | 116/227 |
| 4,590,798 | 5/1986 | Yazaki | 73/323 |
| 4,757,710 | 7/1988 | Haynes | 73/334 |
| 4,789,363 | 12/1988 | Wicklein | 440/2 |
| 4,802,514 | 2/1989 | Morse | 141/86 |
| 4,804,944 | 2/1989 | Golladay et al. | 340/624 |
| 4,815,436 | 3/1989 | Sasaki et al. | 123/520 |
| 4,830,212 | 5/1989 | Nagashima et al. | 220/5 |
| 4,834,150 | 5/1989 | Gadke et al. | 141/98 |
| 4,934,419 | 6/1990 | Lamont et al. | 141/94 |
| 4,987,777 | 1/1991 | Bourret et al. | 73/328 |
| 4,993,460 | 2/1991 | Robinson et al. | 141/94 |
| 5,023,608 | 6/1991 | Delisle, Jr. et al. | 340/984 |
| 5,070,806 | 12/1991 | Coster | 114/343 |
| 5,156,198 | 10/1992 | Hall | 141/94 |
| 5,181,022 | 1/1993 | Schupp | 340/616 |
| 5,229,766 | 7/1993 | Hargest | 340/984 |
| 5,230,372 | 7/1993 | Westphal | 141/86 |
| 5,244,017 | 9/1993 | Hartman et al. | 141/5 |
| 5,249,612 | 10/1993 | Parks et al. | 141/219 |
| 5,301,722 | 4/1994 | Todd et al. | 141/86 |
| 5,322,099 | 6/1994 | Langlois | 141/307 |

*Primary Examiner*—Henry J. Recla
*Assistant Examiner*—Timothy L. Maust
*Attorney, Agent, or Firm*—Woodcock Washburn Kurtz Mackiewicz & Norris

[57] ABSTRACT

A fuel recovery system warns a user of an impending overflow of fuel and also provides an overflow chamber into which relatively small amount of overfilled fuel are captured, thus preventing fuel spillage into the surrounding environment. The system is adapted for use with a fuel tank attached to a fuel fill line and an overflow line, and comprises a float assembly adapted to be coupled inline to the overflow line; an overflow chamber coupled via a check valve to the main fuel tank; and an optical/electronic warning system for warning the user when fuel in the float assembly rises to a predetermined level.

5 Claims, 3 Drawing Sheets

FUEL RECOVERY SYSTEM

FIELD OF THE INVENTION

The present invention relates generally to fuel systems, and more particularly to methods and apparatus for avoiding the spillage of fuel during the refilling of a gas tank. One preferred application of the present invention is in connection with a marine vessel.

BACKGROUND OF THE INVENTION

In the marine industry, it is known to use a "whistler" to avoid the overfilling of a fuel tank. A whistler placed in the overflow line of a fuel system whistles during refueling until it becomes submerged in fuel flowing into the overflow line. A problem with this mechanism is that, by the time the whistler becomes wet, it is too late to prevent the spillage of fuel from the overflow line into the surrounding body of water. Such spillage of fuel into the surrounding water is harmful to the environment.

It is also known to use a sight glass in an overflow line. In theory, one should be able to detect an impending overflow by monitoring the sight glass. However, it is common for multiple overflow lines to be placed on opposite sides of the vessel, so that fuel can overflow from an overflow line that is not within the operator's field of view. In addition, it is not uncommon for the overflow lines to be unlabeled, which can lead to fuel spillage. A goal of the present invention is to prevent such spillage.

SUMMARY OF THE INVENTION

The present invention provides a mechanism whereby the person filling a fuel tank is warned of the impending overflow of fuel into the surroundings. The present invention also provides an overflow reservoir to retain small volumes of overflowed fuel and deliver said small volumes back to the fuel tank, thereby avoiding spillage.

A fuel recovery system in accordance with the present invention is adapted for use with a fuel tank attached to a fuel fill line and an overflow line and comprises a float assembly and an overflow chamber arranged as disclosed hereinbelow. In one presently preferred embodiment of the invention, the float assembly provides a clear and unambiguous visual indication that fuel has risen in the float assembly to a predetermined level, thereby warning the user of an impending overflow. In a second presently preferred embodiment of the invention, an optical/electronic warning system provides an electronic, optical, or audible alarm signal when fuel rises in the float assembly to the predetermined level. Other features of the invention are disclosed below.

DETAILED DESCRIPTION OF PREFERRED EMBODIMENTS

Figure 1:
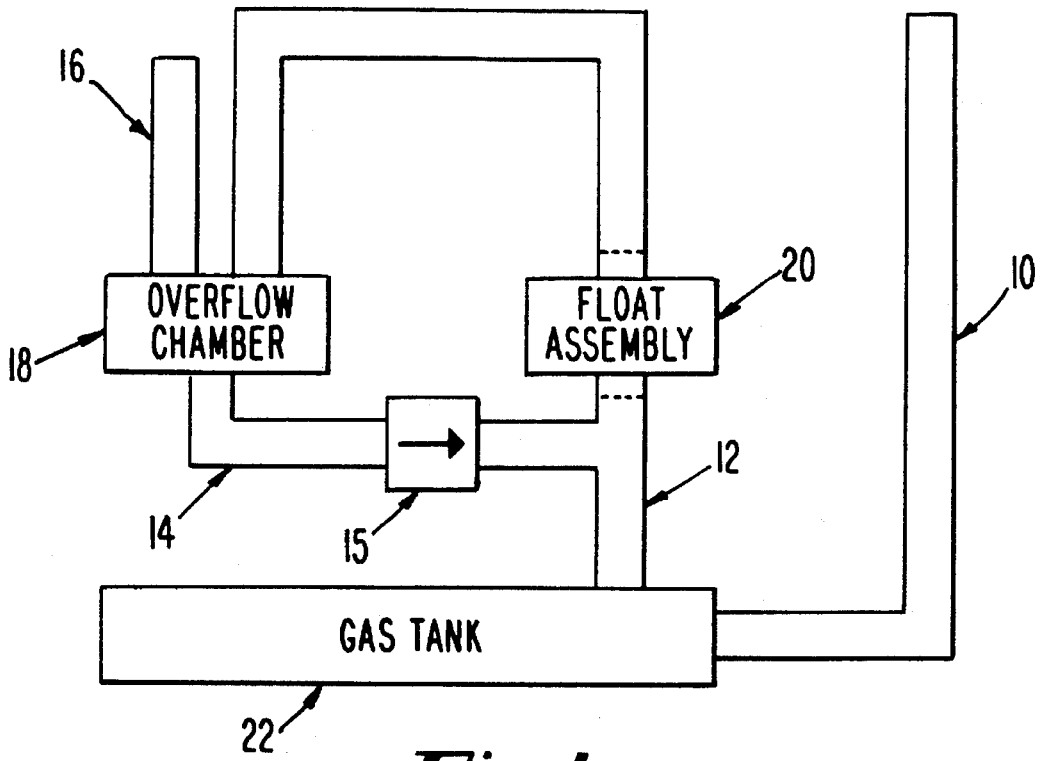
FIG. 1 schematically depicts an overflow containment system in accordance with the present invention.

Referring to FIG. 1, one preferred embodiment of the present invention comprises a fuel fill line 10, an overflow line 12, a return line 14, a check valve 15, a vent 16, an overflow chamber or reservoir 18, a float assembly 20, and a gas tank 22. Fuel is delivered to the tank 22 via the fuel fill line 10. As the tank filling (refueling) operation continues, the fuel will eventually overflow into the overflow line 12. In prior art systems, the overflow line 12 simply drained the overfilled fuel into the surrounding water. In contrast to the prior art, the present invention provides the float assembly 20 and overflow chamber 18, which allow the operator (i.e., the refueler) to avoid overfilling the gas tank 22. The overflow chamber 18 is connected to the return line 14, which carries the overfilled fuel back to the tank 22. The float assembly 20 provides a means whereby the operator is warned of an impending overflow, as described below. According to the invention, an "overflow pending" visual, audible, or electronic alarm indicates that fuel loading should cease. Fuel that has escaped via the float assembly will be directed to the overflow chamber 18, and ultimately through the return line 14 and check valve 15 to the tank 22. That is, as fuel is consumed, the fuel level will drop below the float assembly and fuel will flow from the overflow chamber to the fuel tank.

Figure 2A:
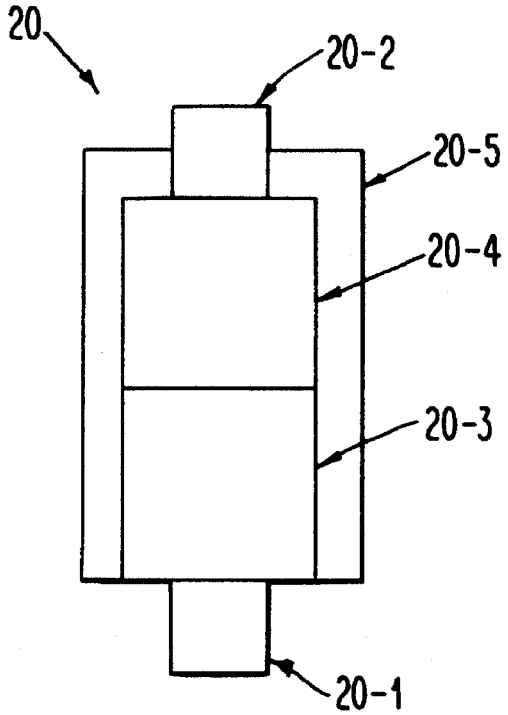
FIG. 2A depicts a front view of the float assembly 20 of FIG. 1.
Figure 2B:
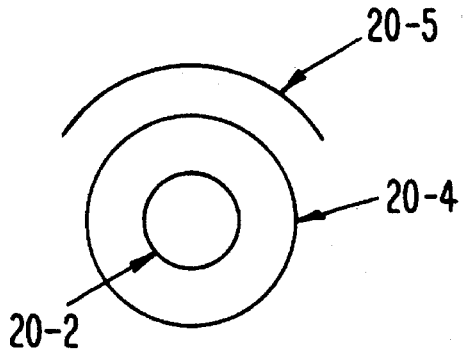
FIG. 2B depicts a top view of the float chamber.

FIGS. 2A and 2B depict front and top views, respectively, of the float assembly 20. The float assembly 20 comprises intake and exhaust nozzles 20-1, 20-2, respectively, for inline connection to the outside vent of the fuel tank 22 (FIG. 1). A lower portion 20-3 of the float assembly is opaque, whereas an upper portion 20-4 is transparent. A reflective surface 20-5 is positioned outside and behind the transparent area 20-4, as shown.

Figure 3:
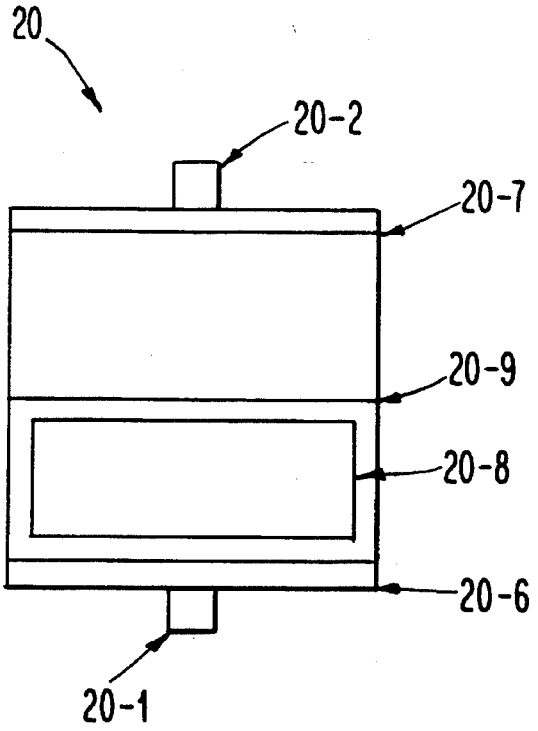
FIG. 3 depicts a cutaway view of the float chamber.

Referring now to FIG. 3, depicting a cutaway view of the float chamber (20), a "gravity-loaded" float 20-8 having a density less than that of the fuel (so that it will float) is disposed within the float assembly 20. FIG. 3 also depicts a bottom plate 20-6 and a top plate 20-7, as well as a line at the midpoint of the float assembly 20-9.

Figure 4:
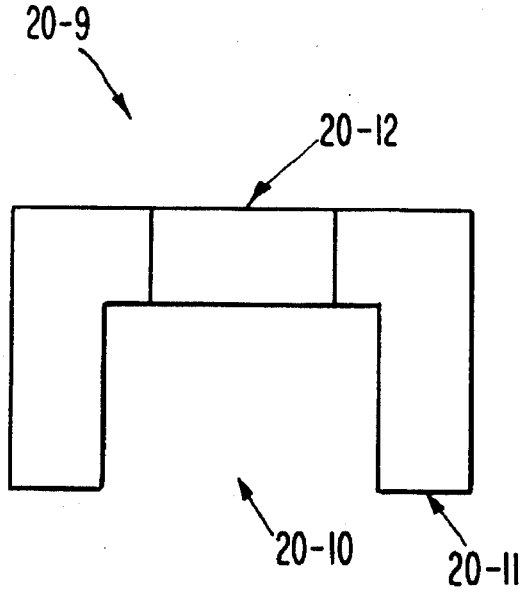
FIG. 4 depicts a cutaway view of the float 20-9.

Referring now to FIG. 4, the float assembly 20-9 includes a portion 20-11 made of a material having a density which is less than that of water or gasoline. In addition, the float includes a restrictive path 20-12 through its center to allow air to pass easier than fuel. There is also a hollow area 20-10 into which fuel will flow when the tank 22 (FIG. 1) is overfilled. It will be appreciated that once the fuel reaches the float it will force the float up into the transparent area 20-4 (FIG. 2A) of the float assembly. This results in a positive visual signal that fuel overflow is pending.

Figure 5:
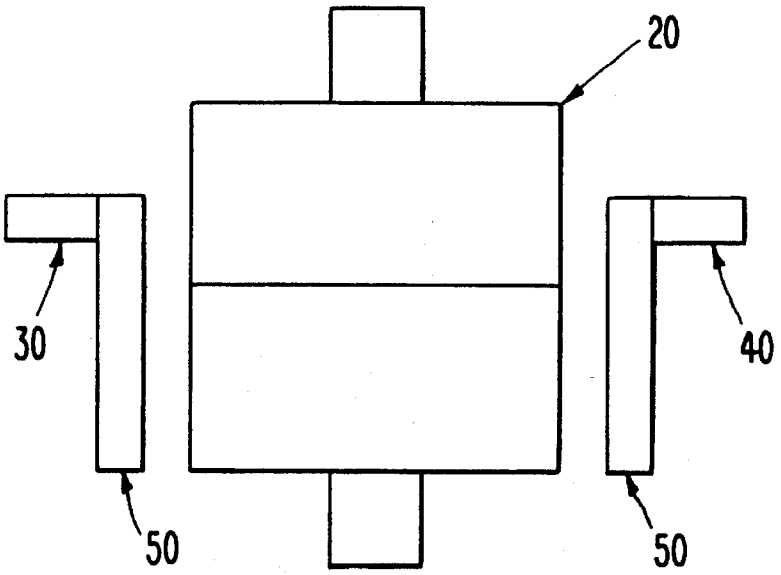
FIG. 5 depicts the float assembly in combination with optical sensing means.

FIG. 5 depicts the float assembly 20 in combination with optical means for providing an optical or electronic signal of an impending fuel overflow. As shown in FIG. 5, this presently preferred embodiment of the invention includes a modulated optical light source 30 and an optical sensor 40, each of which is supported by a bracket 50 as shown. The optical detection system is mounted so that the source and detector are on opposite sides of the float assembly 20 and face each other through the transparent portion 20-4 (FIG. 2A). As the float, which is opaque, rises in the float assembly, it interrupts the optical path between the source 30 and sensor 40.

Preferably, the source and detector are operated in the infrared range. The light source is modulated at a nominal 40 kHz. This is done to eliminate other light (such as sunlight) from interfering with the detection process.

Figure 6:
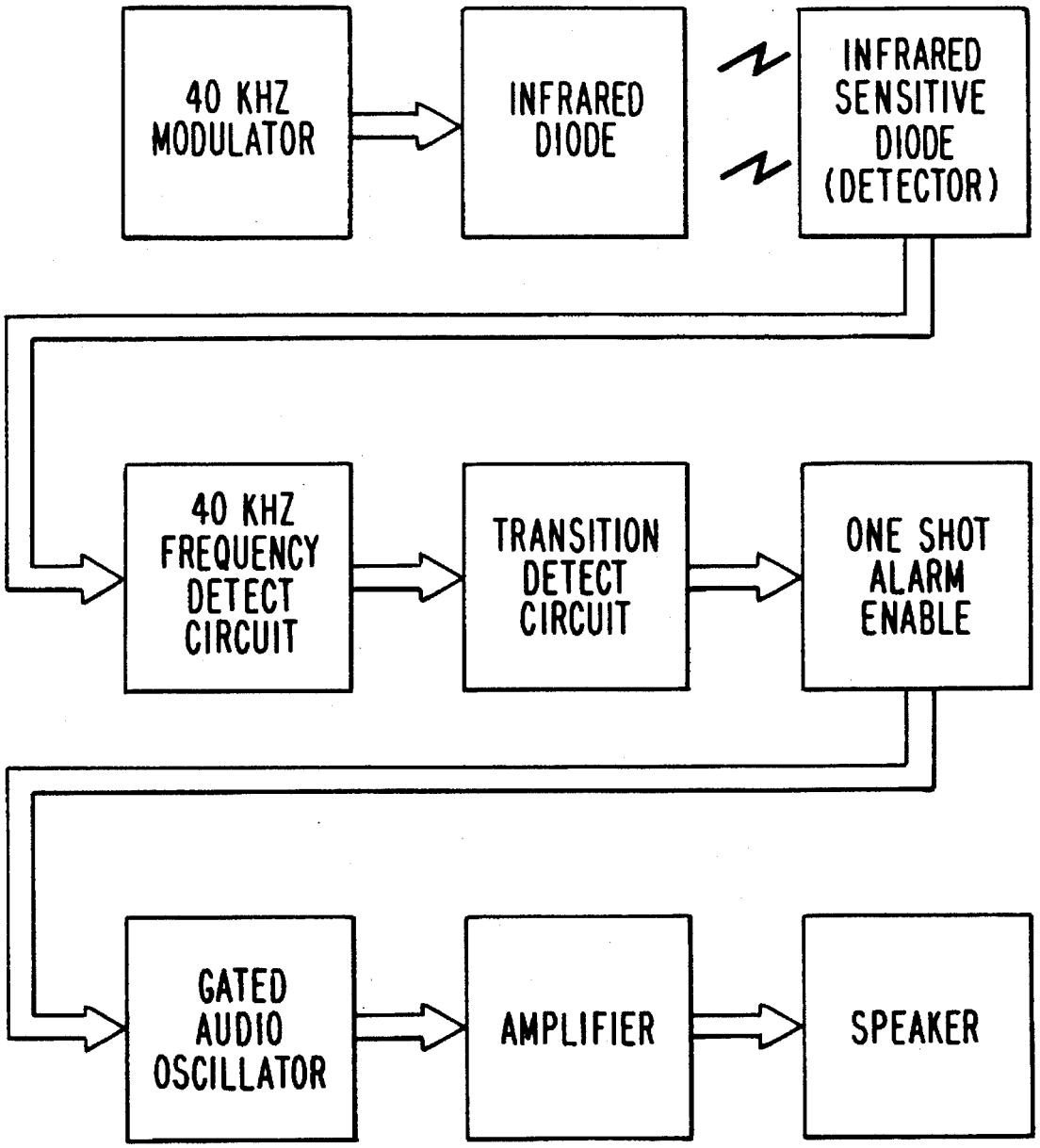
FIG. 6 is a block diagram of an electrical detection system comprising the optical sensing means of FIG. 5.

FIG. 6 is a block diagram of the detection system. As shown, and as previously discussed, the source includes a 40 kHz modulator and an infrared diode. An infrared sensitive diode detects the infrared energy and provides a signal to a frequency detector tuned to 40 kHz, i.e., to the same frequency as the modulated light source. The signal from the frequency detection circuit is in turn fed to a transition detection circuit, which produces a pulse (nominally 10 milliseconds) when a change occurs at the output of the frequency detection circuit. The output of the transition detection circuit is fed to a "one shot," otherwise known as a monostable multivibrator. The "one shot" circuit "extends" the pulse produced by the transition detection circuit and produces an output that gates or enables an audio oscillator. The gated audio oscillator is coupled to a power amplifier and a speaker to produce a loud, audible alarm at a nominal 1 kHz tone.

In the presently preferred embodiment of the invention, all of the above-described circuitry is mounted on a printed circuit board assembly and operates with a nominal 12 VDC power source as typically found in marine vessels.

In another embodiment of the present invention, not shown, a float attached to a magnet is allowed to float in the overflow chamber. A Hall Effect sensor attached to the overflow chamber senses when the magnet, and thus overfilled fuel, in the overflow reservoir reaches a predetermined level. When that predetermined level is reached, the Hall Effect sensor transmits an electrical signal to a voltage comparator. The voltage comparator triggers a flip-flop device, which is reset by a power-on reset circuit. The output of the flip-flop is fed to a gated audio oscillator, which outputs an audio signal when it is gated by the flip-flop. The output of the gated audio oscillator is fed to a power amplifier, which drives a speaker. The speaker emits an audible alarm signal when the fuel in the overflow reservoir rises to the predetermined level. Thus, at this point, the operator is warned that the refueling operation should be discontinued.

In sum, the present invention provides methods and apparatus for use in a fuel system to avoid the overflow of fuel into the surrounding environment. The present invention is particularly useful in connection with a marine vessel to avoid overflow of fuel into a surrounding body of water. The present invention is by no means limited to the specific embodiments disclosed herein, and thus the scope of protection of the following claims is intended not to be limited to the illustrative examples disclosed above.

What is claimed is:

1. A fuel recovery system for preventing spillage of fuel from a fuel tank attached to a fuel fill line and an overflow line, comprising:

(a) a float assembly adapted to be coupled to said overflow line;

(b) an overflow chamber coupled to said float assembly;

(c) a return line coupled to said overflow chamber and adapted to be coupled to said fuel tank for delivering overfilled fuel from said overflow chamber to said fuel tank; and (d) warning means for providing an alarm signal indicating the rise of fuel in said float assembly to a predetermined level, whereby a user is warned of an impending overflow of fuel into said.

2. A fuel recovery system as recited in claim 1, wherein said warning means comprises a modulated optical source, an optical detector, a frequency detection circuit coupled to the optical detector, a transition detection circuit coupled to the frequency detection circuit, an alarm enable circuit coupled to the transition detection circuit, a gated audio oscillator coupled to the alarm enable circuit, an amplifier coupled to the gated audio oscillator, and a speaker coupled to the amplifier, whereby an audible alarm signal is generated when fuel in the float assembly rises to the predetermined level.

3. A fuel recovery system as recited in claim 1, wherein the float assembly comprises a transparent portion, an opaque portion, and a reflective or high contrast surface disposed adjacent said transparent portion, wherein the float rests in the opaque portion and rises into the transparent portion when fuel overflows into the float assembly, whereby the juxtaposition of the float and the reflective or high contrast surface provides a visual indication that fuel has risen in the float assembly to said predetermined level.

4. A fuel recovery system as recited in claim 1, further comprising a check valve disposed in said return line to prevent fuel from overflowing from said fuel tank to said overflow chamber without passing through said float assembly.

5. A fuel recovery system as recited in claim 1, further comprising a vent attached to said overflow chamber.

* * * * *